US006036113A

United States Patent [19]

D'Angelo

[11] Patent Number: 6,036,113

[45] Date of Patent: Mar. 14, 2000

[54] DUAL HEAD SPRAY APPLICATOR

[76] Inventor: Vincent J. D'Angelo, 736 Forestview Dr., Sarasota, Fla. 34232

[21] Appl. No.: 09/205,301

[22] Filed: Dec. 4, 1998

[51] Int. Cl.[7] ..... B05B 7/24; B65D 83/14

[52] U.S. Cl. ..... 239/353; 239/358; 222/402.19

[58] Field of Search ..... 239/337, 340, 239/345, 353, 355, 358; 222/137, 275, 276, 278, 321.8, 402.19

[56] References Cited

U.S. PATENT DOCUMENTS 2,040,302 5/1936 Fortier .

3,088,680 5/1963 Fulton et al. ..... 239/337

4,792,062 12/1988 Goncalves ..... 239/353

*Primary Examiner*—Andres Kashnikow

*Assistant Examiner*—Christopher S. Kim

*Attorney, Agent, or Firm*—Frank A. Lukasik

[57] ABSTRACT

The invention consists of a dual spray head for dispensing a liquid from a container in a vertical position or in an inverted position. A first spray having a long tubular conduit reaching from the spray to a point near the bottom of the container for spraying in a vertical position and a second spray having a short tubular conduit reaching from the spray to a point near the top of the container for dispensing a liquid in an inverted position. The dual spray head may be used in either a pressurized container or a regular container.

4 Claims, 4 Drawing Sheets

DUAL HEAD SPRAY APPLICATOR

BACKGROUND OF THE INVENTION

1. Field of the Invention

This invention relates generally to improved pump sprayers for household and industrial fluids, and more particularly to dual head spray devices that can dispense fluids in a vertical position or in an inverted position.

2. Background of the Invention

Trigger actuated spray dispensers have attained wide spread use for application of a great variety of household and industrial liquids, e.g., insecticides, bug repellants, lubricants, cleaners, cosmetics, sun screens, etc., from the bottles or other containers to which such dispensers are attached for handy, immediate use. As a result, many innovations have been made in the construction of the pumps, spray heads, and other components used in the construction of such spray devices. The present invention has applications generally to all such known and yet to be developed spray devices.

One such spray device is disclosed in U.S. Pat. No. 3,630,418 to Bilchniansky which discloses a dispenser for supplying liquid including a container having a mouth, a permanent liquid seal across the mouth and a permanent and a pair of ducts approaching the bottom of the container and opening thereinto. The ducts extend upwardly through the seal, having their upper ends spaced apart. Before use, a short length of flexible tubing interconnects the upper ends of the ducts to prevent leakage and spillage. One end of the tubing may be disconnected and then connected to a suction inlet so that the connected one of the pair of ducts becomes an aspirating tube and the other provides an air inlet. Multiple container bodies may be supported together.

U.S. Pat. No. 4,475,667 to Ori et al discloses an aerosol assembly which may be used inverted and upright and which, when used in the inverted position, will automatically provide an audible signal that a pre-selected amount of the container contents has been depleted.

U.S. Pat. No. 4,902,281 to Avoy discloses a dispenser for separately dispensing each of two biological fluids for intermixing at a site outside of the dispenser to produce hemostasis or a tissue adhesive. The dispenser is capable of dispensing the biological fluids, such as fibrinogen and thrombin, at a focused point of an aerosol mist.

U.S. Pat. No. 5,542,581 to Habora et al discloses a trigger actuated pump sprayer for application of a great variety of household and industrial liquids for dual service use by inclusion of a spout, which can be operated in a closed mode or an opened mode, mounted to the pump housing and a tubular conduit extending internally of the housing and the cap from the spout to at least the cap for flow of liquid directly from the container on which the sprayer is mounted to the spout whereby liquid may be dispensed from the spout when the user of the sprayer needs larger quantities of the liquid than can conveniently be obtained via the spray pump. The present invention provides a further unique form of a dual service sprayer.

It is therefore an object of the invention to provide spray devices for application of household and industrial liquids.

Another object of the invention is to provide a dual head spray applicator that does not require some associated special construction in the liquid container with which it is associated or attached in order to function.

It is another object of the invention to provide a dual head spray device that can dispense fluids in a vertical position or in an inverted position.

Other objects and many of the attendant advantages of this invention will be readily apparent as the same becomes better understood by reference to the following detailed description when considered in connection with the accompanying drawings in which like reference numerals designate like parts throughout the figures thereof.

SUMMARY OF THE INVENTION

The invention is a dual spray head designed with a short tube from a first spray head to permit spraying with the spray bottle inverted. A second sprayer head is designed with a long tube reaching to the bottom of the spray bottle or can to permit spraying with the bottle in the vertical position. The dual spray head of the invention provides an improvement in known forms of trigger actuated pump spray devices that comprise: a threaded cap for screw attachment to the threaded neck outlet of a container having liquid for application by the device; a hand graspable housing supporting an adjustable spray head and connected to the threaded cap; trigger actuated pump means mounted in the housing; and aerosol can type liquid dispensers.

The improvement of the invention that renders the dual spray head capable of dispensing liquids vertically or inverted, is the provision of a long tubular conduit reaching from a first spray head to the bottom of the container, and the second spray head having a short tubular conduit reaching from the second spray head to the top of the container. The first spray head is used to spray a liquid in the normal, conventional vertical position of the container. The second spray head operates when it is more convenient to hold the container in an inverted position, especially in limited space environments where the vertical position would not be as effective. In a first embodiment, the two spray heads are connected together and operate simultaneously as the heads are depressed. In a second embodiment, the spray heads operate independently on an aerosol can with the first head spraying in the vertical position and the second head spraying in the inverted position.

DESCRIPTION OF THE PREFERRED EMBODIMENT

Figure 1:
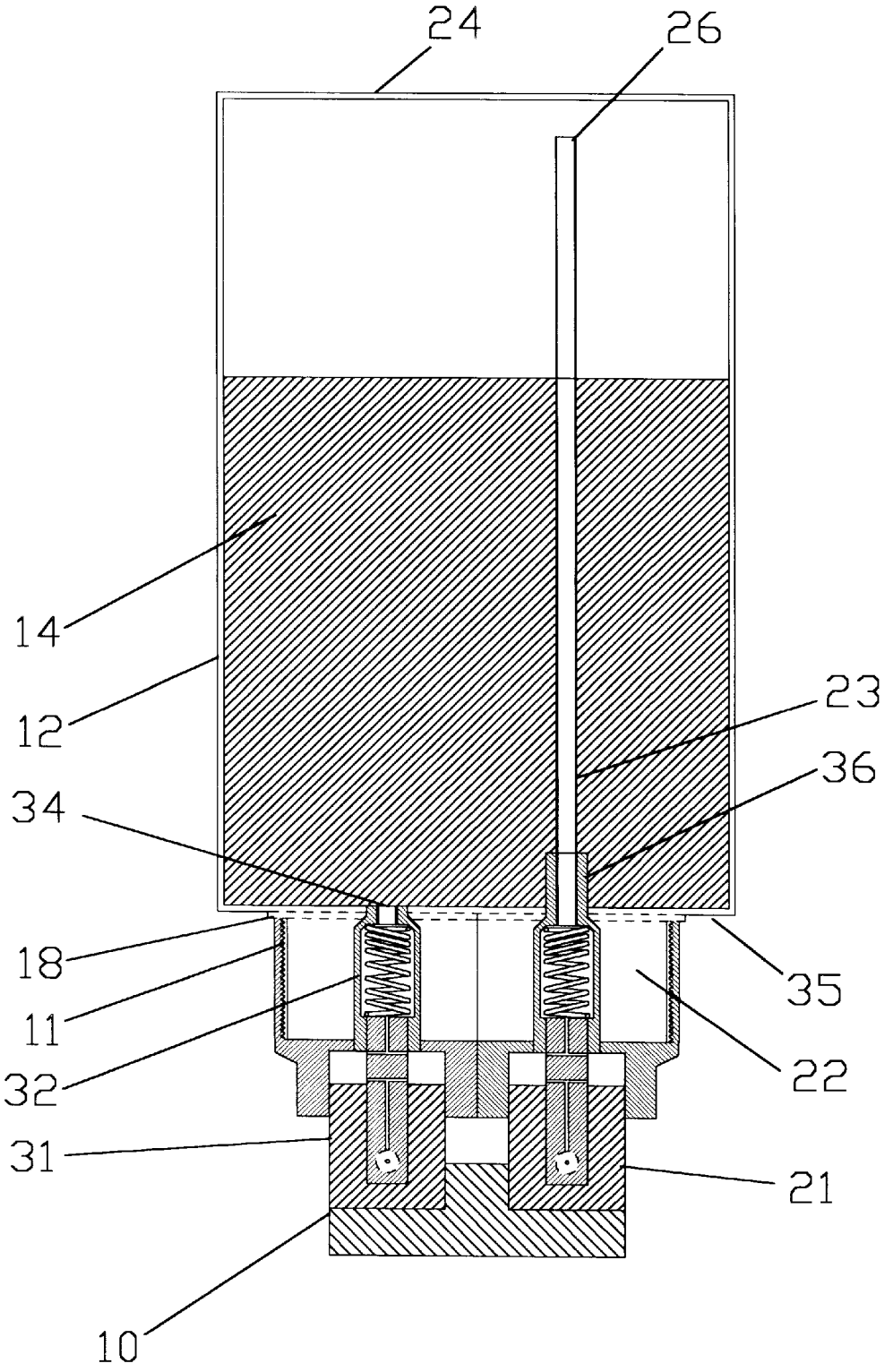
FIG. 1 is a side view, in section, of a dual spray head, mounted on a bottle, operating in an inverted position in accordance with the invention.
Figure 2:
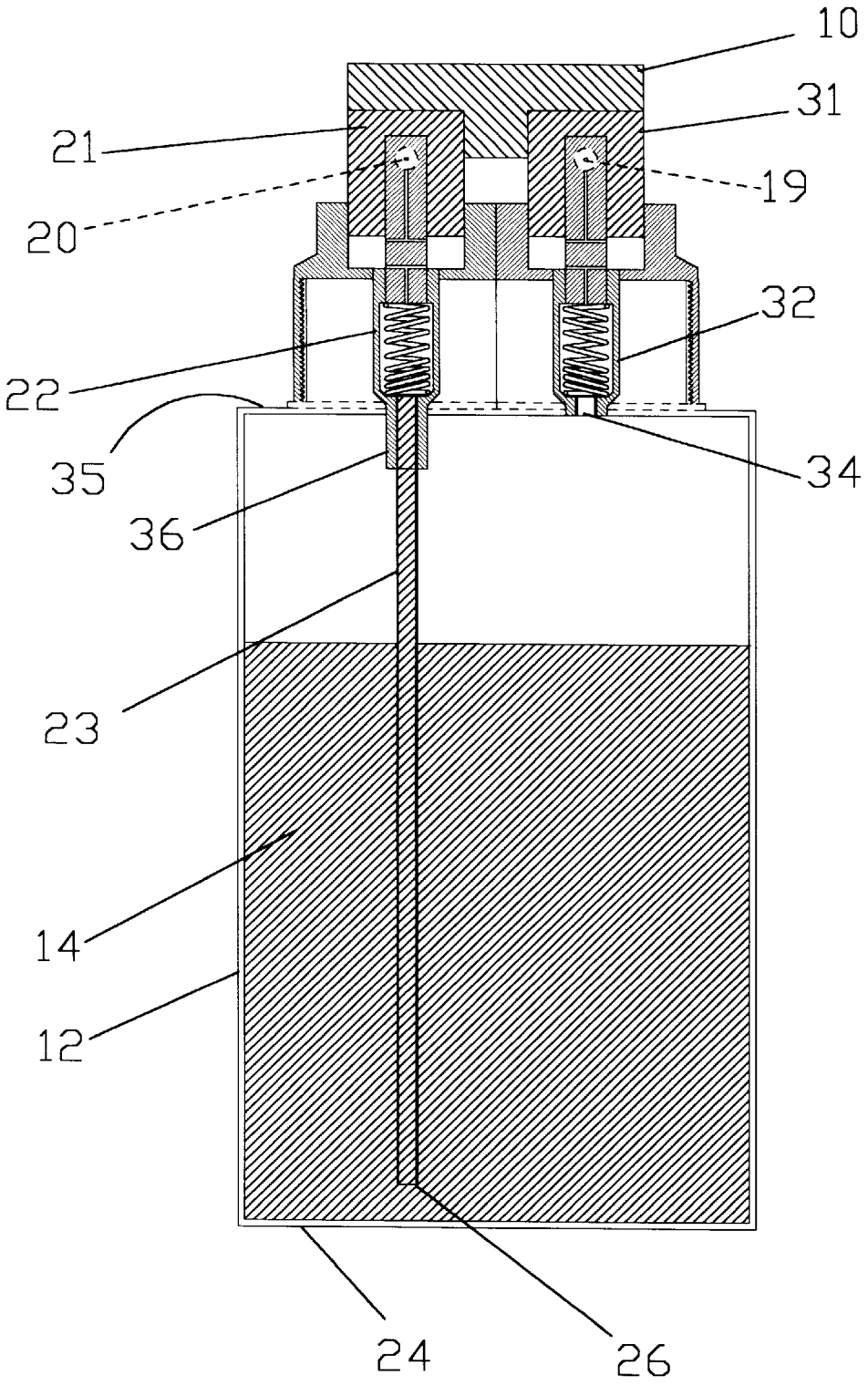
FIG. 2 is a side view, in section, of a dual spray head, mounted on a bottle, in accordance with the invention.

Referring now to the drawings, wherein like reference characteristics designate like or corresponding parts throughout the several views, there are shown sectional views of a dual spray head for dispensing a liquid and designated generally by the numeral 10. FIGS. 1 and 2 are sectional views of a dual spray head 10 attached to a container 12 for supplying a liquid 14 by suction. The dual spray head 10 of the invention comprises a cap 11 attached to a container 12 which may be formed from a variety of materials and by any of a variety of processes as will be appreciated by one of skill in the art.

The container 12 may be made from a variety of materials, including plastic or glass. The dual spray head 10 screw cap 11 shown in FIGS. 1 and 2 may be attached to screw head 18 of container 12. The spray heads 21 and 31 are affixed to the screw cap 11 on the top 35 of container 12. Spray heads 21 and 31 have a spray nozzles 20 and 19, respectively, formed therein. Affixed to the spray pump 32 is a short length of tubing 34 to access the final amount of liquid 14 as the container 12 is emptied.

Spray head 21 has a spray nozzle 20 affixed to the spray pump 22. Affixed to a second end 36 of spray pump 22 is a length of tubing 23 which runs downwardly to the opposite end 26 near the bottom 24 of container 12. The tubing end 26 is in a position to provide a conduit for the liquid 14 when the container is held in a vertical position as shown in FIG. 2.

As shown in FIG. 1, when the spray head 31 is depressed in an inverted position, the liquid 14 is drawn through tubing 34 into the spray pump 32 for discharge as a mist 37 through spray nozzle 19 in a manner well known in the art.

As shown in FIG. 2, when the spray head 21 is depressed in a vertical position, the liquid 14 is drawn through tubing 26, through pump 22 into the spray head 21 for discharge as a mist 37 through spray nozzle 20.

Figure 3:
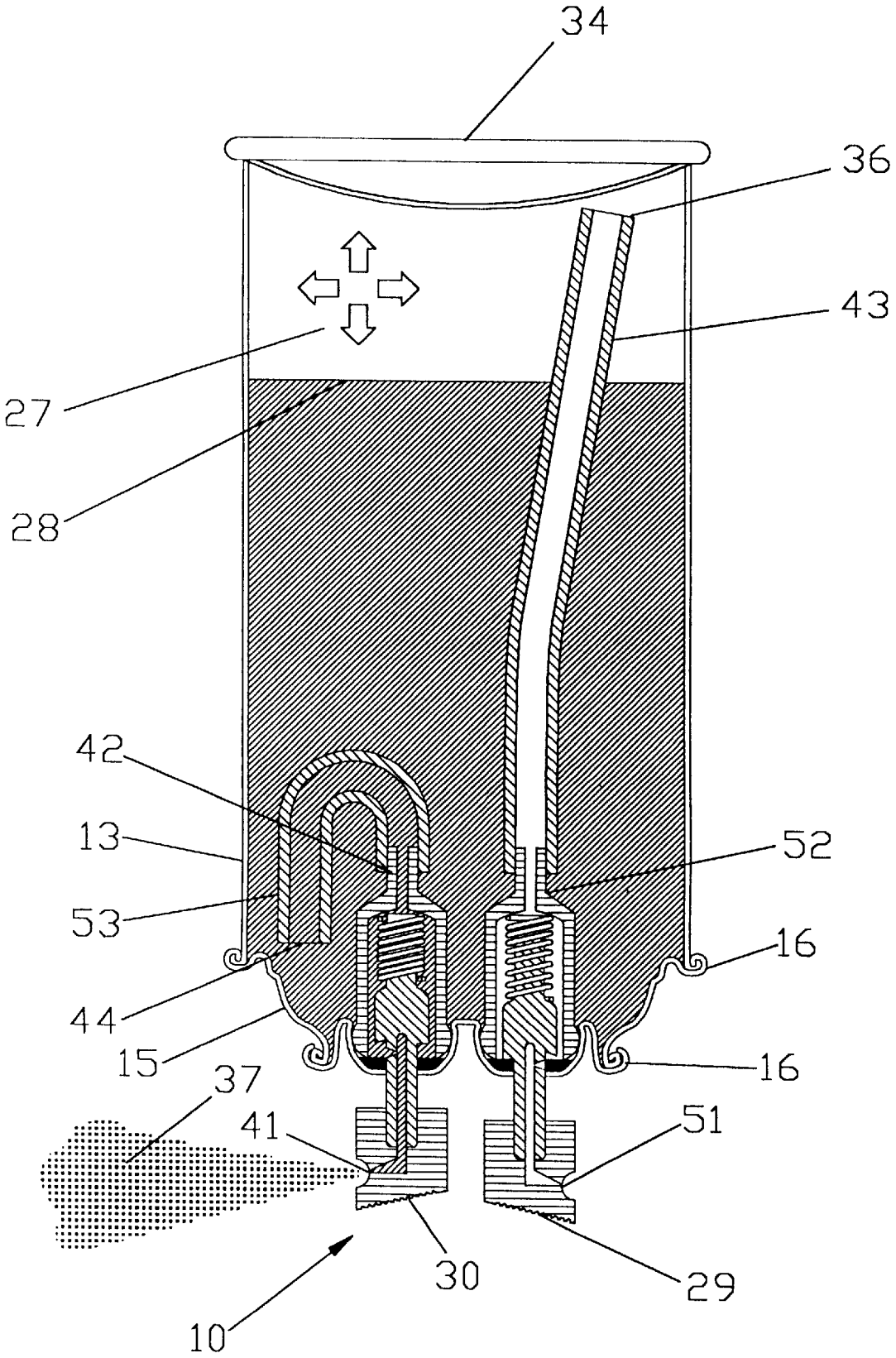
FIG. 3 is a side view, in section, of a dual spray head, mounted on an aerosol can, operating in an inverted position in accordance with the invention.
Figure 4:
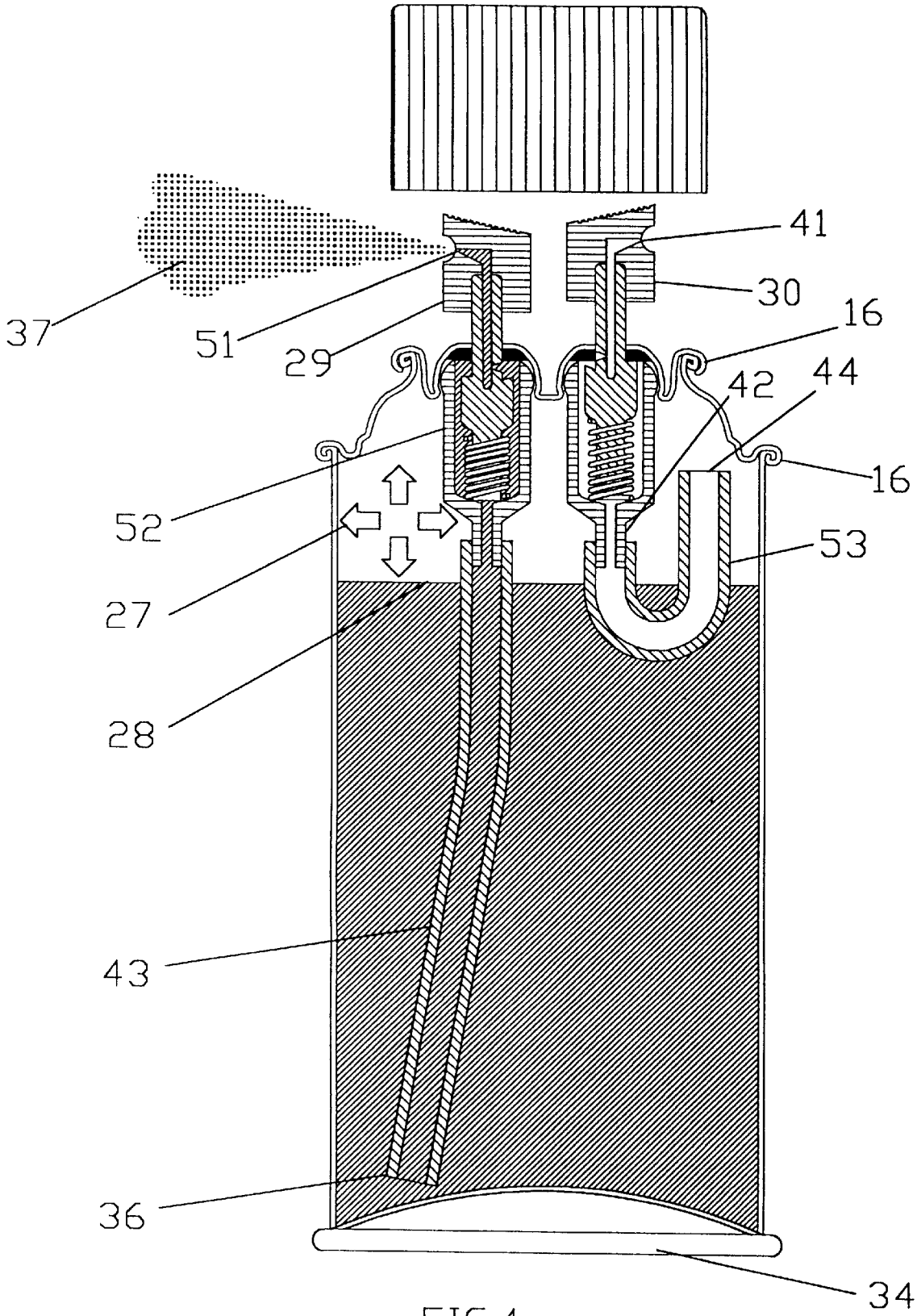
FIG. 4 is a side view, in section, of a dual spray head, mounted on an aerosol can in accordance with the invention.

FIGS. 3 and 4 show the dual spray head 10 of the invention comprising a cap 15 which may be formed and crimped to the container 13 as illustrated by the numeral 16. Spray heads 29 and 30 are mounted on cap 15 and extend within the closed container 13. Spray heads 29 and 30 have spray nozzles 51 and 41 affixed to the release valves 52 and 42 respectively. Affixed to the release valve 52 is a long length of tubing 43 which runs downwardly to the opposite end 36 near the bottom 34 of the container 13.

As shown in FIG. 3, the tubing end 44 is in a position to provide a conduit for the liquid 14 and the container 13 is held in an inverted position. When the spray head 30 is depressed, the aerosol propellant 27 exerts pressure on the top surface 28 of the liquid 14 and the liquid 14 is forced through the tubing 53, and through the spray head 30 where it is sprayed out in the form of a mist 37 in a manner well known in the art. In this embodiment, the spray heads 29 and 30 operate independently rather than singly as in the first embodiment. Spray head 29 operates in the vertical position and the spray head 30 operates in the inverted position.

As shown in FIG. 4, the tubing end 36 is in a position to provide a conduit for the liquid 14 when the container 13 is held in a vertical position. As shown in FIG. 4, when the spray head 29 is depressed, the aerosol propellant 27 exerts pressure on the top surface 28 of liquid 14 and the liquid 14 is forced through the tubing 43, and through the spray head 29 where it is sprayed out in the form of a mist 37 in a manner well known in the art.

The dual head spray 10 of the invention may be used in many situations where it is impractical or impossible to get close enough with a vertical head spray. Each of the heads may be clearly marked as to the position in which it may be used, i.e., vertical or inverted. Even without any marking, it would become immediately obvious if the wrong spray head were used. In the spray pump embodiment, both of the spray pumps 21 and 31 are pressed continuously, one pump spraying a liquid spray and the other spraying air. As the bottle container 12 is inverted, the spraying of liquid and air is reversed.

While the invention has been explained with respect to a preferred embodiment thereof, it is contemplated that various changes may be made in the invention without departing from the spirit and scope thereof.

What is claimed is:

1. A dual spray head for dispensing a liquid from a container in a vertical position or in an inverted position, said spray head comprising:

a cap having means for attaching said cap to a container of liquid, a first spray means mounted in said cap, said spray means having a long tubular conduit reaching from said spray means to a point near the bottom of said container, said first spray means for dispensing a liquid in a vertical position, a second spray means mounted in said cap adjacent to said first spray means, said second spray means having a short tubular conduit from said second spray means to a point near the top of said container for dispensing a liquid in an inverted position, and said first and second spray means having interconnecting means for simultaneously operating said first and second spray means.

2. A dual spray head for dispensing a liquid from a container in a vertical position or in an inverted position as defined in claim 1 wherein said cap is attached to said container with a mating screw thread, and each of said first and second spray means consist of a spray pump for drawing a liquid from said container into a spray head for discharge as a mist through a spray nozzle.

3. A dual spray head for dispensing a liquid from a container in a vertical or in an inverted position, said spray head comprising:

a cap is attached to said container by a method of crimping, a first spray means mounted in said cap, said spray means having a long tubular conduit reaching from said spray means to a point near the bottom of said container, said first spray means for dispensing a liquid in a vertical position, a second spray means mounted in said cap adjacent to said first spray means, said second spray means having a short tubular conduit from said second spray means to a point near the top of said container for dispensing a liquid in an inverted position, and each of said first and second spray means consisting of a valve for releasing a liquid under pressure in said container into a spray head for discharge as a mist through a spray nozzle.

4. A dual spray head for dispensing a liquid from a container in a vertical or in an inverted position as defined in claim 3 wherein said short tubular conduit is "U" shaped.

* * * * *